US009552768B2

(12) United States Patent
Takeda et al.

(10) Patent No.: US 9,552,768 B2
(45) Date of Patent: Jan. 24, 2017

(54) DISPLAY DEVICE INCLUDING A DEFECTIVE PIXEL CORRECTING SYSTEM

(71) Applicant: Japan Display Inc., Tokyo (JP)

(72) Inventors: Nobuhiro Takeda, Tokyo (JP); Toshihiro Sato, Tokyo (JP)

(73) Assignee: Japan Display Inc., Tokyo (JP)

( * ) Notice: Subject to any disclaimer, the term of this patent is extended or adjusted under 35 U.S.C. 154(b) by 131 days.

(21) Appl. No.: 14/551,126

(22) Filed: Nov. 24, 2014

(65) Prior Publication Data

US 2015/0145851 A1 May 28, 2015

(30) Foreign Application Priority Data

Nov. 25, 2013 (JP) ..... 2013-243250

(51) Int. Cl.
*G09G 3/32* (2016.01)

(52) U.S. Cl.
CPC ..... *G09G 3/3233* (2013.01); *G09G 3/3275* (2013.01); *G09G 2320/029* (2013.01); *G09G 2330/10* (2013.01); *G09G 2330/12* (2013.01); *G09G 2370/08* (2013.01)

(58) Field of Classification Search
CPC ... G09G 3/20; G09G 3/2092; G09G 2320/043
See application file for complete search history.

(56) References Cited

U.S. PATENT DOCUMENTS

2006/0164407 A1* 7/2006 Cok ..... G09G 3/20 345/204
2008/0246785 A1 10/2008 Shirasaki et al.
2010/0053040 A1* 3/2010 Nishi ..... G09G 3/20 345/76

FOREIGN PATENT DOCUMENTS

JP 2008-241803 A 10/2008

* cited by examiner

*Primary Examiner* — Nalini Mummalaneni
*Assistant Examiner* — Sepehr Azari
(74) *Attorney, Agent, or Firm* — Typha IP LLC

(57) ABSTRACT

A display device is provided with an image processing circuit that outputs a pixel value of each pixel to a pixel driving circuit, the pixel driving circuit that inputs a pixel voltage to each of pixels based on the pixel value of each of the pixels, and a control circuit that detects a defective pixel. Here, the image processing circuit corrects the pixel value of the defective pixel in the image data to be displayed which is input to the image processing circuit, to a pixel value for black, and then outputs each pixel value of the image data to be displayed in which the pixel value of the defective pixel is corrected to the pixel value for black, to the pixel driving circuit.

6 Claims, 9 Drawing Sheets

FIG.6

| | | | | | | | | | | | | | | | | |
|---|---|---|---|---|---|---|---|---|---|---|---|---|---|---|---|---|
| 14a | 65 | 27 | 101 | ~ | ~ | ~ | ~ | ~ | ~ | ~ | ~ | ~ | ~ | ~ | ~ | ~ |
| 14b | 127 | 58 | ~ | ~ | ~ | ~ | ~ | ~ | ~ | ~ | ~ | ~ | ~ | ~ | ~ | ~ |
| 14c | 100 | 53 | 78 | ~ | ~ | ~ | ~ | ~ | ~ | ~ | ~ | ~ | ~ | ~ | ~ | ~ |

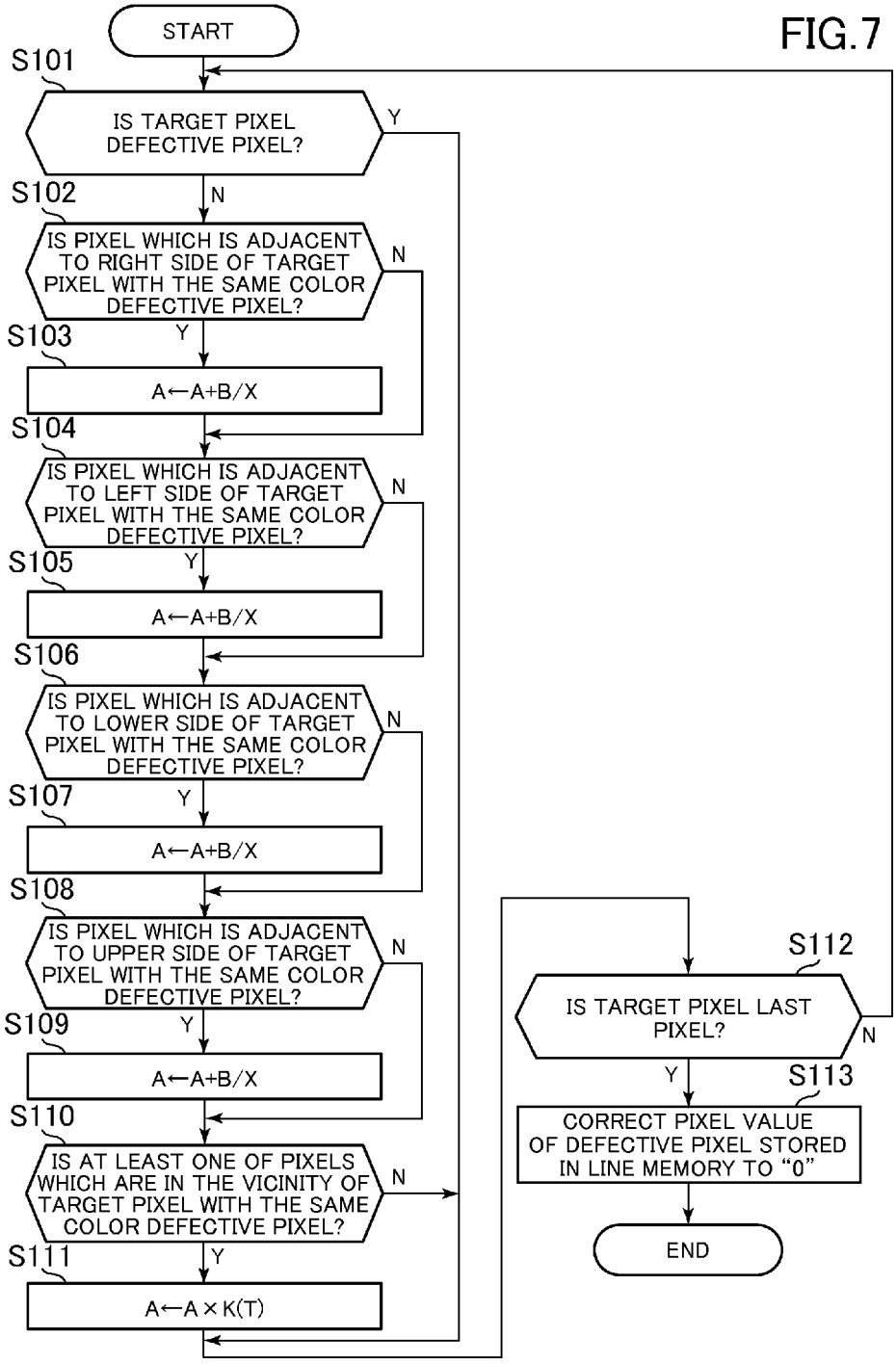
FIG.7
START
S101
IS TARGET PIXEL DEFECTIVE PIXEL?
Y
N
S102
IS PIXEL WHICH IS ADJACENT TO RIGHT SIDE OF TARGET PIXEL WITH THE SAME COLOR DEFECTIVE PIXEL?
N
Y
S103
A←A+B/X
S104
IS PIXEL WHICH IS ADJACENT TO LEFT SIDE OF TARGET PIXEL WITH THE SAME COLOR DEFECTIVE PIXEL?
N
Y
S105
A←A+B/X
S106
IS PIXEL WHICH IS ADJACENT TO LOWER SIDE OF TARGET PIXEL WITH THE SAME COLOR DEFECTIVE PIXEL?
N
Y
S107
A←A+B/X
S108
IS PIXEL WHICH IS ADJACENT TO UPPER SIDE OF TARGET PIXEL WITH THE SAME COLOR DEFECTIVE PIXEL?
N
Y
S109
A←A+B/X
S110
IS AT LEAST ONE OF PIXELS WHICH ARE IN THE VICINITY OF TARGET PIXEL WITH THE SAME COLOR DEFECTIVE PIXEL?
N
Y
S111
A←A×K(T)
S112
IS TARGET PIXEL LAST PIXEL?
N
Y
S113
CORRECT PIXEL VALUE OF DEFECTIVE PIXEL STORED IN LINE MEMORY TO "0"
END

FIG.8

| | | |
|---|---|---|
| R | Q | R |
| Q | P | Q |
| R | Q | R |

$$P' = 0$$

$$Q' = K(T) \times (Q+P/X) \cdots (X=4)$$

P: DEFECTIVE PIXEL
Q: PIXELS WHICH ARE ADJACENT TO UPPER, LOWER, RIGHT, AND LEFT SIDES OF DEFECTIVE PIXEL
R: PIXELS OBLIQUELY ADJACENT TO DEFECTIVE PIXEL

FIG.9

| | | |
|---|---|---|
| R | Q | R |
| Q | P | Q |
| R | Q | R |

$$P' = 0$$

$$Q' = K(T) \times (Q+P/X) \cdots (X=4+2\sqrt{2})$$

$$R' = K(T) \times (R+P/Y) \cdots (Y=\sqrt{2} \cdot X)$$

P: DEFECTIVE PIXEL
Q: PIXELS WHICH ARE ADJACENT TO UPPER, LOWER, RIGHT, AND LEFT SIDES OF DEFECTIVE PIXEL
R: PIXELS OBLIQUELY ADJACENT TO DEFECTIVE PIXEL

DISPLAY DEVICE INCLUDING A DEFECTIVE PIXEL CORRECTING SYSTEM

CROSS-REFERENCE TO RELATED APPLICATIONS

The present application claims priority from Japanese application JP 2013-243250 filed on Nov. 25, 2013, the content of which is hereby incorporated by reference into this application.

BACKGROUND OF THE INVENTION

1. Field of the Invention

The present invention is related to a display device.

2. Description of Related Art

A display device has been known, which is provided with a display panel formed of a plurality of pixels, each of which includes a current drive type light emitting element and a controlling element controlling current passing through the light emitting element based on an input pixel voltage. For example, the display panel is disclosed in JP 2008-241803 A. The display device disclosed in JP 2008-241803 A is configured to derive an offset voltage to all pixels and emit light to each light emitting element based on the offset voltage with prescribed luminance.

SUMMARY OF THE INVENTION

In the display device as described above, the display panel may include a defective pixel including the light emitting element in which an anode and a cathode are short-circuited by foreign matter. In such a defective pixel, even in a case where the light emitting element does not emit light, a large amount of current is consumed in the light emitting element.

An object of the present invention is to cause current being consumed in a defective pixel to be suppressed in a display device which is provided with a display panel formed of a plurality of pixels including a current drive type light emitting element and controlling current passing through a light emitting element based on an input pixel voltage.

According to an aspect of the present invention, there is provided a display device including a display panel that is formed of a plurality of pixels, each of which includes a current drive type light emitting element and controls current passing through the current drive type light emitting element based on an input pixel voltage; an image processing circuit that outputs a pixel value of each of the pixels; a pixel voltage input circuit that inputs a pixel voltage to each of the pixels based on the pixel value of each of the pixels output from the image processing circuit, and a defect detecting circuit that detects a defective pixel having a defect among the plurality of pixels, in which the image processing circuit includes a correction circuit that corrects the pixel value of the defective pixel in image data to be displayed which is input to the image processing circuit, and then outputs each pixel value of the image data to be displayed in which the pixel value of the defective pixel is corrected, to the pixel voltage input circuit, and the correction circuit corrects the pixel value of the defective pixel to a pixel value for black.

In the aspect, the current drive type light emitting element may be an organic EL element and the defective pixel may be a pixel including the organic EL element in which an anode and a cathode are short-circuited.

In the aspect, the correction circuit may correct a pixel value of a related pixel, of the image data to be displayed, having a prescribed positional relationship to the defective pixel based on the pixel value of the defective pixel and correct the pixel value of the defective pixel in the image data to be displayed to the pixel value for black, and then output each pixel value of the image data to be displayed in which the pixel value of the defective pixel and the related pixel are corrected, to the pixel voltage input circuit.

In the aspect, a plurality of unit areas may be set in the display panel and the defect detecting circuit may determine, for each unit area, whether or not the unit area is a defective area including the defective pixel and then detect the defective pixel in the unit area determined as the defective area.

In the aspect, the image processing circuit may further include an image for detecting output circuit that obtains image data, the image data including the pixel value of each of the pixels for defect detection, only each of the pixel value of some of the pixels being not a pixel value for black, and then outputs each pixel value of the obtained image data to the pixel voltage input circuit, the display device may further include a current measuring unit that measures a total amount of the current passing through the current drive type light emitting element in the pixel of which the pixel value is not the pixel value for black, the image for detecting output circuit may obtain, for each unit area, the image data for defect detection of which the pixel value only in the unit area is not the pixel value for black, and then output each pixel value of the obtained image data to the pixel voltage input circuit, and the defect detecting circuit may determine whether or not the unit area is the defective area based on the measured value obtained from the current measuring unit in a case where all pixel values of the image data for defect detection of which the pixel value only in the unit area is not the pixel value for black are output to the pixel voltage input circuit.

In the aspect, the image for detecting output circuit may obtain, for each of the pixels in the defective area, the image data for defect detection of which the pixel value only in the pixel is not the pixel value for black, and then output each pixel value of the obtained image data to the pixel voltage input circuit, and the defect detecting circuit may determine whether or not the pixel in the defective area is the defective pixel based on the measured value obtained from the current measuring unit in a case where all pixel values of the image data for defect detection of which the pixel value only in the pixel is not the pixel value for black are output.

In addition, the correction circuit may correct the pixel value of the related pixel based on the pixel value of the defective pixel and a value according to an elapsed time from a reference timing.

BRIEF DESCRIPTION OF THE DRAWINGS

FIG. 6 is a diagram illustrating a line memory which is provided in a gradation correction circuit.

FIG. 7 is a flow chart illustrating a process performed in a gradation correction circuit.

FIG. 8 is a diagram illustrating a correction example of a pixel value.

FIG. 9 is a diagram illustrating a correction example of a pixel value.

DETAILED DESCRIPTION OF THE INVENTION

Hereinafter, detailed description will be given below the examples of the invention with reference to the attached drawings.

Figure 1:
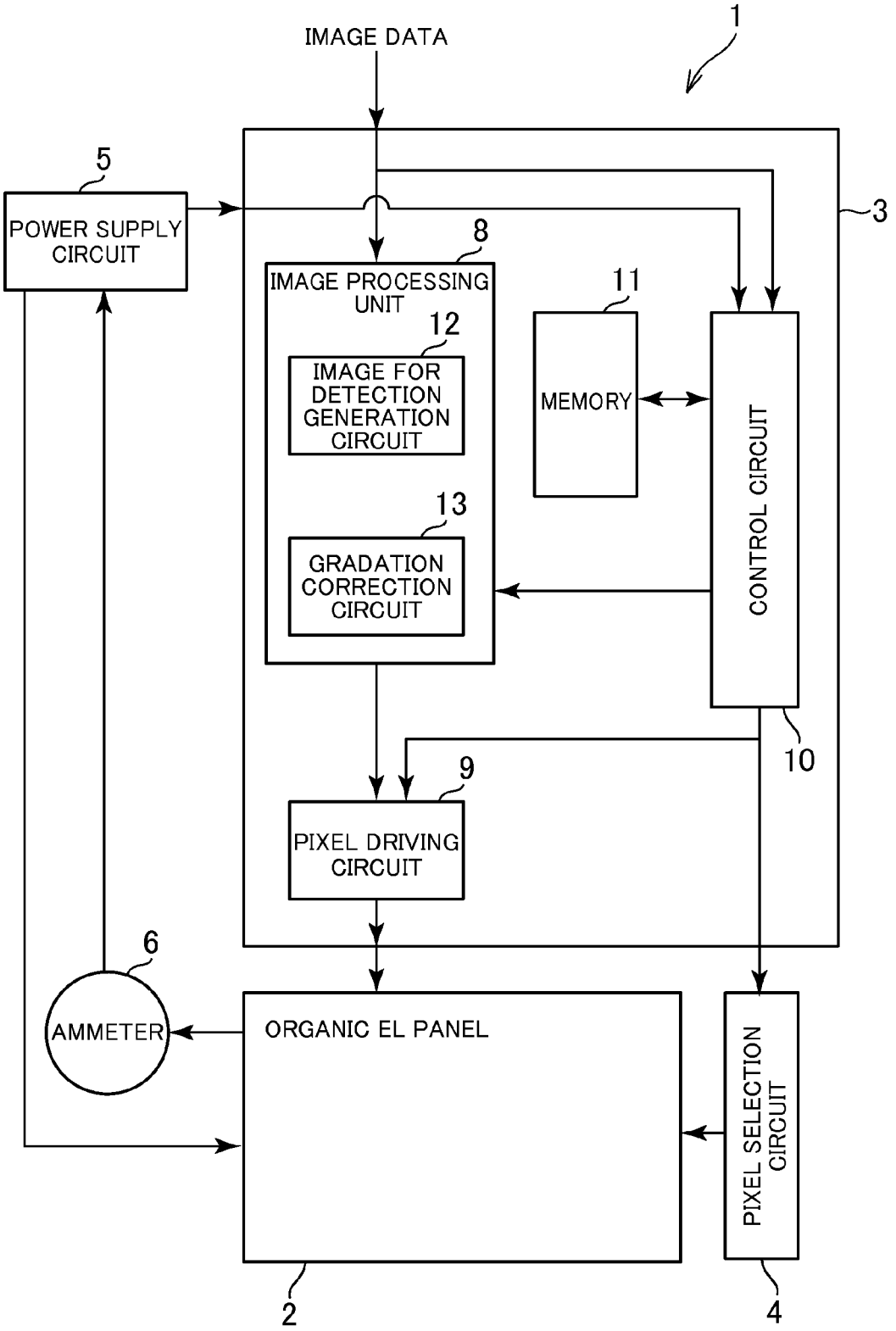
FIG. 1 is a diagram illustrating a configuration of a display device according to an embodiment of the present invention.

FIG. 1 is a diagram illustrating a display device 1 according to an embodiment of the present invention. In this embodiment, the display device 1 is implemented as an organic EL display and provided with an organic EL panel 2, a driver 3, a pixel selection circuit 4, a power supply circuit 5, an ammeter 6, or the like. The organic EL panel 2 is a general organic EL panel and is formed of a plurality of pixels which include an organic EL element, that is, a current drive type light emitting element. As pixels, three types of an R pixel which is a red pixel, a G pixel which is a green pixel and a B pixel which is a blue pixel are provided. A power supply voltage is supplied to each of the pixels from the power supply circuit 5 so as to cause emission of the organic EL element.

The pixel selection circuit 4 selects a pixel in the organic EL panel 2. In other words, the pixel selection circuit 4 inputs a selection signal to the pixel to be selected.

The driver 3 is provided with an image processing unit 8, a pixel driving circuit 9, a control circuit 10, and a memory 11. The image data to be displayed which is obtained from the outside is input to the image processing unit 8. The image data to be displayed includes a pixel value of each of the pixels. The image processing unit 8 outputs the pixel value of each of the pixels to the pixel driving circuit 9. In this embodiment, if an operating mode is a normal mode, the image processing unit 8 outputs the pixel value of each of the pixels on the basis of the image data to be displayed to the pixel driving circuit 9. In addition, if the operating mode is a detection mode, the image processing unit 8 outputs the pixel value of each of the pixels on the basis of the image data the image processing unit 8 generated to the pixel driving circuit 9. Description of the operating mode will be made later.

Figure 2:
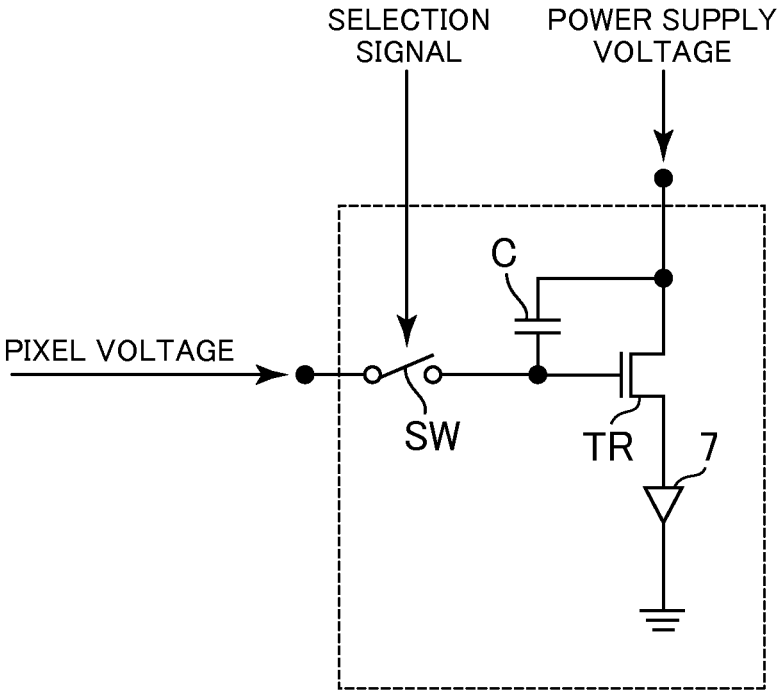
FIG. 2 is a diagram illustrating an example of a configuration of a pixel.

The pixel driving circuit 9 inputs the pixel voltage to each of the pixels based on the pixel value of each of the pixels output from the image processing unit 8. The pixel voltage which is input to each of the pixels is a voltage corresponding to the pixel value of each of the pixels. Each of the pixels controls the current passing through the organic EL element based on the input pixel voltage. FIG. 2 is a diagram illustrating an example of a configuration of a pixel. A portion of the inside of a dotted line indicates one pixel. As shown in FIG. 2, the pixel includes a switch SW, a capacity C, a driving transistor TR, and an organic EL element 7. A pixel voltage, the selection signal, and the power supply voltage are input to the pixel and the switch SW is turned on when the selection signal is input to the pixel and accumulates the pixel voltage into the capacitor C. The driving transistor TR supplies the driving current to the organic EL element 7 in response to the pixel voltage accumulated in the capacitor C. A luminance of light emission of the organic EL element 7 is determined by the pixel voltage accumulated in the capacity C and the power supply voltage supplied from the power supply circuit 5. However, in a case where the pixel voltage accumulated in the capacity C is a pixel voltage corresponding to a pixel value for black indicating the minimum-gradation data, a driving current does not pass through the organic EL element 7.

Meanwhile, the driving current passing through each of the organic EL elements 7 is input to the ammeter 6. A total amount of the driving current passing through each of the organic EL elements 7 is measured by means of the ammeter 6. The measured value of the ammeter 6 is input to the power supply circuit 5. The power supply circuit 5 supplies the power supply voltage not only to each of the pixels but also to the driver 3. In the embodiment, a configuration is set such that a level or a pulse width of the power supply voltage is adjusted in response to the measured value of the ammeter 6, the power supply voltage being supplied to the driver 3 as measurement data indicating the measured value of the ammeter 6.

The measurement data or the image data to be displayed is input to the control circuit 10. The control circuit 10 supplies a signal indicating a current operating mode or a signal indicating which pixel of the pixel value should be output to the pixel driving circuit 9 to the image processing unit 8. In addition, the control circuit 10 supplies a signal indicating which pixel should be input to which pixel voltage to the pixel driving circuit 9. Further, the control circuit 10 supplies a signal indicating to which pixel and at which timing the selection signal should be input to the pixel selection circuit 4.

In a case where the operating mode is the detection mode, the control circuit 10 detects the defective pixel in the organic EL panel 2. Here, the defective pixel means a pixel including an organic EL element 7 in which the anode and the cathode are short-circuited due to foreign matter. In the defective pixel, the driving current passing through the organic EL element 7 becomes higher due to the short-circuit. However, the driving current does not pass through a light emitting layer any more, which results in the organic EL element 7 not emitting. To briefly explain a detection method for a defective pixel, the control circuit 10 narrows down the defective area including the defective pixel in the organic EL panel 2 and detects the defective pixel from the narrowed down defective area.

Figure 3:
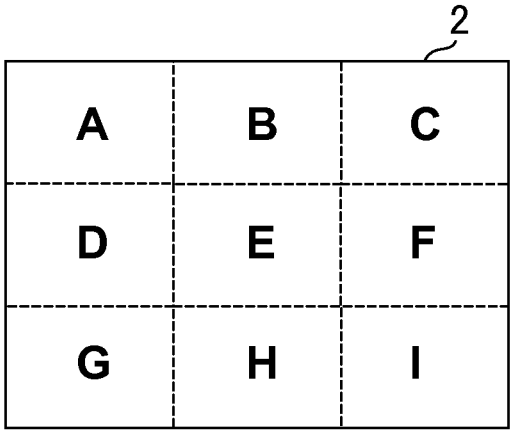
FIG. 3 is a diagram illustrating unit areas which are set in an organic EL panel.

Specifically, as shown in FIG. 3, nine unit areas of unit area A to unit area I are set in the organic EL panel 2. When an image for detection generation circuit 12 is provided in the image processing unit 8 and the operating mode is a detection mode, nine items of first image data for detection of first image data for detection A to first image data for detection I are generated in order. The first image data for detection includes the pixel value each of the pixels and the image for detection generation circuit 12 causes each of these items of first image data for detection to be displayed on the organic EL panel 2 in order. That is, the pixel value of each of the pixels is output to the pixel driving circuit 9 from the first image data for detection A in order.

Figure 4:
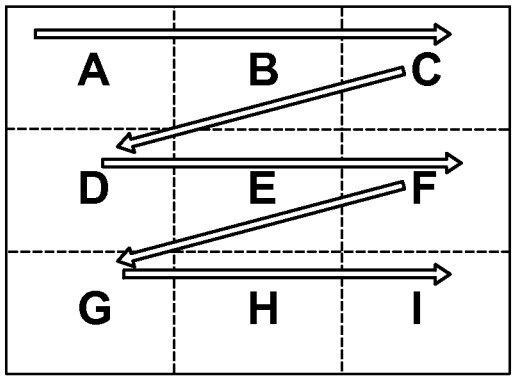
FIG. 4 is a diagram illustrating a display order of first image data for detection.

Here, the first image data for detection A is the image data in which the pixel value of a pixel outside the unit area A is the pixel value for black and the pixel value of a pixel inside the unit area A is a reference value other than the pixel value for black, and the first image data for detection B is the image data in which the pixel value of a pixel outside the unit area B is the pixel value for black and the pixel value of a pixel inside the unit area B is the aforementioned reference value. In addition, the first image data for detection C is the image data in which the pixel value of a pixel outside the unit area C is the pixel value for black and the pixel value of a pixel inside the unit area C is the aforementioned reference value, and the first image data for detection D is the image data in which the pixel value of a pixel outside the unit area D is the pixel value for black and the pixel value of a pixel inside the unit area D is the aforementioned reference value. Further, the first image data for detection E is the image data in which the pixel value of a pixel outside the unit area E is the pixel value for black and the pixel value of a pixel inside the unit area E is the aforementioned reference value, the first image data for detection F is the image data in which the pixel value of a pixel outside the unit area F is the pixel value for black and the pixel value of a pixel inside the unit area F is the aforementioned reference value, and the first image data for detection G is the image data in which the pixel value of a pixel outside the unit area G is the pixel value for black and the pixel value of a pixel inside the unit area G is the aforementioned reference value. In addition, the first image data for detection H is the image data in which the pixel value of a pixel outside the unit area H is the pixel value for black and the pixel value of a pixel inside the unit area H is the aforementioned reference value, and the first image data for detection I is the image data in which the pixel value of a pixel outside the unit area I is the pixel value for black and the pixel value of a pixel inside the unit area I is the aforementioned reference value. FIG. 4 is a diagram illustrating a display order of the first image data for detection. Arrows indicate the display order.

In the pixel in which the pixel voltage corresponding to the pixel value for black is input, the fact that the driving current does not pass through the organic EL element 7 is described above. For that reason, for example, the measured value obtained by the ammeter 6 during the display of the first image data for detection A becomes a total amount of the driving current passing through the organic EL elements 7 inside the unit area A. Every time the first image data for detection is displayed, the control circuit 10 determines whether or not the measured value indicated by the measurement data is equal to or greater than a predetermined first threshold value. The control circuit 10 determines, for each unit area, whether or not the unit area is the defective area including the defective pixel. For example, the description "determining whether or not the measured value is equal to or greater than the first threshold value when the first image data for detection A is displayed" means determining whether or not the unit area A is the defective area.

In this manner, the control circuit 10 narrows down the unit area which may be the defective area.

Figure 5:
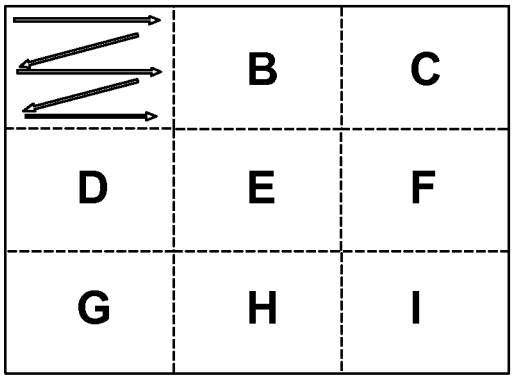
FIG. 5 is a diagram illustrating a display order of second image data for detection.

Next, the control circuit 10 detects the defective pixel from the unit area which is determined as the defective area. In other words, the control circuit 10 generates, for each pixel in the unit area determined as the defective area, second image data for detection which is the image data of which the pixel value of pixels is the above described reference value and the pixel value of other pixels is the pixel value for black. Further, each of these items of generated second image data for detection is caused to be displayed on the organic EL panel 2 in order. That is, the pixel value of each of the pixels is output to the pixel driving circuit 9 from the second image data for detection which is the first in display order. FIG. 5 is a diagram illustrating a display order of the second image data for detection in a case where the unit area A is the defective area. Arrows indicate the display order.

The fact that the driving current does not pass through the organic EL elements 7 in the pixels in which the pixel voltage corresponding to the pixel value for black is input is described above. For that reason, for example, the measured value obtained by the ammeter 6 when the second image data for detection which is the first in display order is displayed becomes the driving current passing through the organic EL element 7 of the pixel of the upper left vertex in the unit area A (refer to FIG. 5). Accordingly, in a case where the measured value is relatively high, it is considered that the pixel of the upper left vertex in the unit area is the defective pixel. Therefore, every time the second image data for detection is displayed, the control circuit 10 determines whether or not the measured value indicated by the measurement data is equal to or greater than a predetermined second threshold value. In this manner, the control circuit 10 determines, for each pixel in the unit areas determined as the defective area, whether or not a pixel is the defective pixel. In addition, the control circuit 10 records an address of the pixel determined as the defective pixel in the memory 11. For example, the description "determining whether or not the measured value is equal to or greater than the second threshold value when the second image data for detection which is the first in display order is displayed" means determining whether or not the pixel of the upper left vertex in the unit area is the defective pixel.

In this manner, the control circuit 10 detects the defective pixel and stores the address of the defective pixel in the memory 11.

In this way, in the display device 1, the unit areas including the defective pixel are narrowed down first and then the defective pixel is detected from the unit area including the defective pixel. Therefore, without narrowing down the unit areas including the defective pixel, it is possible to detect the defective pixel using a simpler process than in a case where determining whether or not the measured value is equal to or greater than the second threshold value by generating the second image data for detection with respect to all pixels in the organic EL panel 2.

Next, a case where the operating mode is the normal mode will be described. In the normal mode, the address of the defective pixel which is recorded in the memory 11 is read out to be supplied to the image processing unit 8 by the control circuit 10. In the normal mode, the image processing unit 8 outputs the pixel value of each of the pixels to the pixel driving circuit 9 based on the image data to be displayed. In this manner, the image processing unit 8 causes the organic EL panel 2 to display the image to be displayed. Note that, in order to prevent the current from being wastefully consumed due to the defective pixel, a gradation correction circuit 13 is provided in the image processing unit 8 and is configured to correct the pixel value of the defective pixel in the image data to be displayed to the pixel value for black. Then, the gradation correction circuit 13 is configured to output each pixel value of the image data to be displayed in which the pixel value of the defective pixel is corrected to the pixel value for black, to the pixel driving circuit 9.

In addition, the organic EL element 7 does not emit light in the defective pixel, and thus decrease in the luminance is caused. Thus, the gradation correction circuit 13 is configured to increase the pixel value of the related pixel which has a prescribed positional relationship to the defective pixel based on the pixel value of the defective pixel. Here, the related pixel means a pixel having the same color as that of the defective pixel and pixels including all pixels which are adjacent to the upper, lower, right, and left sides of the defective pixel. Then, each of the pixel values of the image data in which the pixel value of the defective pixel is corrected to the pixel value for black and the pixel value of the related pixel which is increased is output to the pixel driving circuit 9. In this manner, the decrease in luminance caused by the defective pixel can be compensated for.

Further, the gradation correction circuit 13 is configured to take into account the degradation of the organic EL element 7 of the related pixel over time in correcting the pixel value of the related pixel. That is, the gradation correction circuit 13 is configured to increase the pixel value of the related pixel based on not only the pixel value of the defective pixel but also a value of a monotonically increasing function K(T) with respect to elapsed time T from the time of manufacturing the display device 1. In this manner, the decrease of the luminance caused by the defective pixel can be reliably compensated.

In this embodiment, three line memories 14*a*, 14*b*, and 14*c* as shown in FIG. 6 are provided in the gradation correction circuit 13. Each of the line memories corresponds to one pixel line. The pixel information regarding each of the pixels in corresponding pixel lines is stored in the line memories. The pixel information includes the address and the pixel value of the pixels. The gradation correction circuit 13 reads a pixel information row stored in the line memory 14*a* and outputs the pixel values in the read pixel information to the pixel driving circuit 9 at a predetermined period. In addition, the gradation correction circuit 13 updates the pixel information row stored in the line memory 14*a* and the pixel information row stored in the line memory 14*b* to the pixel information row stored in the line memory 14*b* and the pixel information row stored in the line memory 14*c* respectively. And the gradation correction circuit 13 updates the pixel information row stored in the line memory 14*c* to a new pixel information row of a pixel line. Every time the pixel information row stored in the line memory 14*b* is updated to the pixel information row stored in the line memory 14*c*, the gradation correction circuit 13 selects the pixel information in the line memory 14*b* in order from the left and performs a process for the selected pixel information as illustrated in a flow chart of FIG. 7. Hereinafter, FIG. 7 will be explained with the selected pixel information being denoted as target pixel information and a pixel corresponding to the target pixel information being denoted as a target pixel.

That is, the gradation correction circuit 13 determines whether or not the target pixel is the defective pixel (S101). This means that the gradation correction circuit 13 determines whether or not the address of the target pixel information is the same as any address of a defective pixel. When the target pixel is a defective pixel (Y in S101), the process of the gradation correction circuit 13 proceeds to step S112.

On the other hand, when the target pixel is not a defective pixel (N in S101), the gradation correction circuit 13 determines whether or not a pixel which is adjacent to the right side of the target pixel with the same color is a defective pixel (S102). In this case, since two pixels having the same color are disposed side by side every two pixels in the pixel line, the gradation correction circuit 13 determines whether or not the address of the third pixel information on the right side of the target pixel information is the same as any address of a defective pixel. When the pixel which is adjacent to the right side of the target pixel with the same color is a defective pixel (Y in S102), the pixel value A of the target pixel (the pixel value of the target pixel information) is updated based on the pixel value B of the pixel which is adjacent to the right side of the target pixel with the same color (the pixel value of the third pixel information on the right side of the target pixel information) (S103). That is, the gradation correction circuit 13 adds B/X to the pixel value A. Here, "X" denotes "4". On the other hand, if the pixel which is adjacent to the right side of the target pixel with the same color is not a defective pixel (N in S102), the process of the gradation correction circuit 13 proceeds to step S104 without the pixel value A being corrected.

In step S104, the gradation correction circuit 13 determines whether or not the pixel which is adjacent to the left side of the target pixel with the same color is a defective pixel (S104). In this case, the gradation correction circuit 13 determines whether or not the address of the third pixel information on the left side of the target pixel information is the same as any address of a defective pixel. When the pixel which is adjacent to the left side of the target pixel with the same color is a defective pixel (Y in S104), the pixel value A of the target pixel (the pixel value of the target pixel information) is updated based on the pixel value B of the pixel which is adjacent to the left side of the target pixel with the same color (the pixel value of the third pixel information on the left side of the target pixel information) (S105). That is, the gradation correction circuit 13 adds B/X to the pixel value A. On the other hand, if the pixel which is adjacent to the left side of the target pixel with the same color is not a defective pixel (N in S104), the process of the gradation correction circuit 13 proceeds to step S106 without the pixel value A being corrected.

In step S106, the gradation correction circuit 13 determines whether or not the pixel which is adjacent to the lower side of the target pixel with the same color is a defective pixel (S106). In this case, the gradation correction circuit 13 determines whether or not the address of the pixel information immediately below the target pixel information, stored in the line memory 14*c*, is the same as any address of a defective pixel. When the pixel which is adjacent to the lower side of the target pixel with the same color is a defective pixel (Y in S106), the pixel value A of the target pixel (the pixel value of the target pixel information) is updated based on the pixel value B of the pixel which is adjacent to the lower side of the target pixel with the same color (the pixel value of the pixel information immediately below the target pixel information, stored in the line memory 14*c*) (S107). That is, the gradation correction circuit 13 adds B/X to the pixel value A. On the other hand, if the pixel which is adjacent to the lower side of the target pixel with the same color is not a defective pixel (N in S106), the process of the gradation correction circuit 13 proceeds to step S108 without the pixel value A being corrected.

In step S108, the gradation correction circuit 13 determines whether or not the pixel which is adjacent to the upper side of the target pixel with the same color is a defective pixel (S108). In this case, the gradation correction circuit 13 determines whether or not the address of the pixel information immediately above the target pixel information, stored in the line memory 14*a*, is the same as any address of a defective pixel. When the pixel which is adjacent to the upper side of the target pixel with the same color is a defective pixel (Y in S108), the pixel value A of the target pixel (the pixel value of the target pixel information) is updated based on the pixel value B of the pixel which is adjacent to the upper side of the target pixel with the same color (the pixel value of the pixel information immediately above the target pixel information, stored in the line memory 14*a*) (S109). That is, the gradation correction circuit 13 adds B/X to the pixel value A. On the other hand, if the pixel which is adjacent to the upper side of the target pixel with the same color is not a defective pixel (N in S108), the process of the gradation correction circuit 13 proceeds to step S110 without the pixel value A being corrected.

In step S110, the gradation correction circuit 13 determines whether or not at least one of the pixels which are in the vicinity of the target pixel with the same color (that is, the pixels which are adjacent to the upper, lower, right, and left sides of the target pixel with the same color) is a defective pixel (S110). When at least one of the pixels which are in the vicinity of the target pixel with the same color is a defective pixel (Y in S110), the gradation correction circuit 13 reads out a value of the function K(T) stored in the memory 11 to correct the pixel value A of the target pixel (the pixel value of the target pixel information) based on the value of function K(T) (S111). That is, the gradation correction circuit 13 multiplies the pixel value A by the value of the function K(T). On the other hand, when a defective pixel does not exist in any of the pixels which are in the vicinity of the target pixel with the same color (N in S110), the process of the gradation correction circuit 13 proceeds to step S112 without the pixel value A being corrected. In the same manner, when the target pixel is a defective pixel (Y in S101), the gradation correction circuit 13 performs the step S112. When the target pixel is a defective pixel (Y in S101), the pixel value A is not corrected.

In step S112, the gradation correction circuit 13 determines whether or not the target pixel is the last pixel in the pixel line corresponding to the line memory 14*b* (S112). That is, the gradation correction circuit 13 determines whether or not the target pixel information is the pixel information stored at the rightmost side of the line memory 14*b*. When the target pixel is not the last pixel (N in S112), the pixel information which is adjacent to the right side of the target pixel information is selected as a new target pixel information and steps after S101 are performed again. On the other hand, when the target pixel is the last pixel (Y in S112), the gradation correction circuit 13 corrects the pixel value of the defective pixel stored in the line memory 14*a* to the pixel value for black "0" (S113). That is, the gradation correction circuit 13 specifies the pixel information including the same address as that of the defective pixel of the pixel information stored in the line memory 14*a* and corrects the pixel value of the specified pixel information to the pixel value for black. The pixel value of the defective pixel is corrected to the pixel value for black through the step S113.

FIG. 8 is a diagram illustrating a correction example of the pixel value through the process shown in FIG. 7. P denotes the pixel value of the defective pixel, Q denotes the pixel value of the pixels which are adjacent to the upper, lower, right, and left sides of the defective pixel with the same color, and R denotes the pixel values of the pixels obliquely adjacent to the defective pixel. According to the process in FIG. 7, the corrected pixel value P' of the defective pixel is the pixel value for black "0". The pixel value Q' of the corrected pixels which are adjacent to the upper, lower, right, and left sides of the target pixel with the same color is "K (T)×(Q+P/X)". That is, the pixel value P of the defective pixel before being corrected is evenly distributed and then the pixel value is multiplied by the value of the function K(T).

As described above, the pixel value of the defective pixel is corrected to the pixel value for black in the display device 1. For that reason, it is possible to prevent current from being wastefully consumed due to the defective pixel.

In addition, the pixel values of the pixels in the vicinity of the defective pixel are corrected on the basis of the pixel value of the defective pixel. Thus, it is possible to correct the decrease in luminance due to the organic EL element 7 which does not emit light in the defective pixel.

Meanwhile, the embodiments of the invention are not limited to the above described embodiments.

For example, the gradation correction circuit 13 may correct the pixel value of the pixel which is obliquely adjacent to the defective pixel with the same color based on the pixel value of the defective pixel. FIG. 9 is a diagram illustrating a correction example of the pixel value in this case. R' denotes the corrected pixel value of the pixel which is obliquely adjacent to the defective pixel with the same color. In this case, the pixel value P of the defective pixel before being corrected is distributed to the pixel which is obliquely adjacent to the defective pixel with the same color. Therefore, the value of "X" is changed and a distribution amount of the pixel value of the pixels which are adjacent to the upper, lower, right, and left sides of the defective pixel is reduced compared with the case of FIG. 8. However, the distribution amount of the pixel value of the pixels which are adjacent to the upper, lower, right, and left sides of the defective pixel with the same color is assumed to be larger compared with the distribution amount of the pixel value of the pixels which are obliquely adjacent to the defective pixel with the same color.

While there have been described what are at present considered to be certain embodiments of the invention, it will be understood that various modifications may be made thereto, and it is intended that the appended claim cover all such modifications as fall within the true spirit and scope of the invention.

What is claimed is:

1. A display device comprising:

a display panel that is formed of a plurality of pixels, each of which includes a current drive type light emitting element and controls current passing through the current drive type light emitting element based on an input pixel voltage;

an image processing circuit that outputs a pixel value of each of the pixels;

a pixel voltage input circuit that inputs a pixel voltage to each of the pixels based on the pixel value of each of the pixels output from the image processing circuit; and a defect detecting circuit that detects a defective pixel having a defect among the plurality of pixels, wherein the image processing circuit includes a correction circuit that corrects the pixel value of the defective pixel in image data to be displayed which is input to the image processing circuit, and then outputs each pixel value of the image data to be displayed in which the pixel value of the defective pixel is corrected, to the pixel voltage input circuit, wherein the correction circuit corrects the pixel value of the defective pixel to a pixel value for black, wherein a plurality of unit areas are set in the display panel, and wherein the defect detecting circuit determines, for each unit area, whether or not the unit area is a defective area including the defective pixel and then detects the defective pixel in the unit area determined as the defective area.

2. The display device according to claim 1, wherein the current drive type light emitting element is an organic EL element, and wherein the defective pixel is a pixel including an organic EL element in which an anode and a cathode are short-circuited.

3. The display device according to claim 1, wherein the correction circuit corrects a pixel value of a related pixel, of the image data to be displayed, having a prescribed positional relationship to the defective pixel based on the pixel value of the defective pixel and corrects the pixel value of the defective pixel in the image data to be displayed to the pixel value for black, and then outputs each pixel value of the image data to be displayed in which the pixel value of the defective pixel and the related pixel are corrected, to the pixel voltage input circuit.

4. The display device according to claim 3, wherein the correction circuit corrects the pixel value of the related pixel based on the pixel value of the defective pixel and a value according to an elapsed time from the time of manufacturing the display device.

5. The display device according to claim 1, wherein the image processing circuit further includes an image for detecting output circuit that obtains image data, the image data including the pixel value of each of the pixels for defect detection, only each of the pixel value of some of the pixels being not a pixel value for black, and then outputs each pixel value of the obtained image data to the pixel voltage input circuit, wherein the display device further comprises a current measuring unit that measures a total amount of the current passing through the current drive type light emitting element in the pixel of which the pixel value is not the pixel value for black, wherein the image for detecting output circuit obtains, for each unit area, the image data for defect detection of which the pixel value only in the unit area is not the pixel value for black, and then outputs each pixel value of the obtained image data to the pixel voltage input circuit, and wherein the defect detecting circuit determines whether or not the unit area is the defective area based on the measured value obtained from the current measuring unit in a case where all pixel values of the image data for defect detection of which the pixel value only in the unit area is not the pixel value for black are output to the pixel voltage input circuit.

6. The display device according to claim 5, wherein the image for detecting output circuit obtains, for each of the pixels in the defective area, the image data for defect detection of which the pixel value only in the pixel is not the pixel value for black, and then outputs each pixel value of the obtained image data to the pixel voltage input circuit, and wherein the defect detecting circuit determines whether or not the pixel in the defective area is the defective pixel based on the measured value obtained from the current measuring unit in a case where all pixel values of the image data for defect detection of which the pixel value only in the pixel is not the pixel value for black are output.

* * * * *